US005233803A

United States Patent [19]

Bockmiller

[11] Patent Number: 5,233,803

[45] Date of Patent: Aug. 10, 1993

[54] FRAMING APPARATUS FOR CLEAN ROOM WALL SYSTEM

[76] Inventor: Douglas F. Bockmiller, 5601 Balmoral Dr., Oakland, Calif. 94619

[21] Appl. No.: 847,587

[22] Filed: Mar. 5, 1992

[51] Int. Cl.[5] ..... E04B 1/00

[52] U.S. Cl. ..... 52/239; 52/239; 52/241; 52/584; 52/774

[58] Field of Search ..... 52/281, 235, 239, 771, 52/774, 778, 309.7, 282, 584, 775, 309.11, 241

[56] References Cited

U.S. PATENT DOCUMENTS

| | | | |
|---|---|---|---|
| 3,267,631 | 8/1966 | Hammitt | 52/771 |
| 3,300,919 | 1/1967 | Hiller | 52/584 |
| 3,449,877 | 6/1969 | Beckman | 52/127.12 |
| 3,861,112 | 1/1975 | Caroselle | 52/584 |
| 3,924,374 | 12/1975 | Volper | 52/281 |
| 4,601,137 | 7/1986 | Bates | 52/281 |
| 4,644,717 | 2/1987 | Biebuyck | 52/209 |
| 4,891,920 | 1/1990 | Pingston | 52/584 |
| 4,896,473 | 1/1990 | Liebetrau | 52/235 |
| 4,910,938 | 3/1990 | McGee | 52/775 |
| 4,984,400 | 1/1991 | Bockmiller | 52/241 |

*Primary Examiner*—Carl D. Friedman
*Assistant Examiner*—Winnie Yip
*Attorney, Agent, or Firm*—Thomas R. Lampe

[57] ABSTRACT

Framing apparatus for use in forming clean room walls from wall panels. The framing apparatus includes an elongated structural member having opposed contact surfaces positionable between adjacent panel opposed ends and gaskets disposed in elongated recesses formed in the elongated structural member which compress and form an air-tight seal between the panels and framing apparatus upon assembly.

8 Claims, 6 Drawing Sheets

FRAMING APPARATUS FOR CLEAN ROOM WALL SYSTEM

TECHNICAL FIELD

This invention relates to the construction of clean room wall assemblies. More particularly, the invention is directed to framing apparatus including elongated structural means which allows for the ready assembly or disassembly of panels from either side of the wall.

BACKGROUND ART

My U.S. Pat. No. 4,984,400, issued Jan. 15, 1991, is directed to a clean room channel wall system utilizing an extruded framing member as a means for joining panels, including wall panels. Such channel wall system has attained a considerable degree of commercial success and is widely employed The apparatus of U.S. Pat. No. 4,984,400, however, requires assembly from one side of the wall, usually the back side, the objective being to provide a finished appearance only at the side of the wall, typically the front side, opposed to the assembly side.

DISCLOSURE OF INVENTION

The framing system of the present invention, in contrast, permits assembly of a clean room wall from either side. Furthermore, the wall, when constructed, presents a finished appearance from both sides thereof. Assembly may be carried out quickly without utilization of special tools. Furthermore, the assembled wall incorporates wall panels which are maintained together in an essentially air-tight manner.

According to the teachings of the present invention, framing apparatus is positionable between opposed ends of adjacent panels for connecting the panels and allowing selective assembly and disassembly of the panels relative to the framing apparatus from opposed sides of the panels.

The framing apparatus includes elongated structural means having opposed contact surfaces positionable between the adjacent panel opposed ends and engageable by the opposed ends at the opposed contact surfaces.

The elongated structural means defines a plurality of spaced elongated recesses extending substantially along the length of the elongated structural means and including connector means for interconnecting the elongated structural means and the opposed panel ends.

Gasket means is disposed in the elongated recesses. The gasket means extends substantially along the lengths of the recesses and projects outwardly therefrom when the gasket means is in an unstressed condition. The gasket means compresses and forms a generally air-tight seal between the panels when the framing apparatus and the panels are assembled. Also, any particulates, such as particulates from fasteners employed in the system, are contained.

In a preferred embodiment of the invention, the elongated structural means includes an elongated core member, the opposed contact surfaces being disposed on opposite sides of the elongated core member for abutting engagement with panels assembled with the framing apparatus.

The connector means includes a pair of elongated flange members and fastener means for releasably fastening the elongated flange members to the elongated core member with panels positioned between the elongated flange members and the elongated flange members maintaining adjacent panels in at least partial registry. The fastener means is selectively accessible from opposed sides of the elongated core member.

Other features, advantages, and objects of the present invention will become apparent with reference to the following description and accompanying drawings.

MODES FOR CARRYING OUT THE INVENTION

Figure 1:
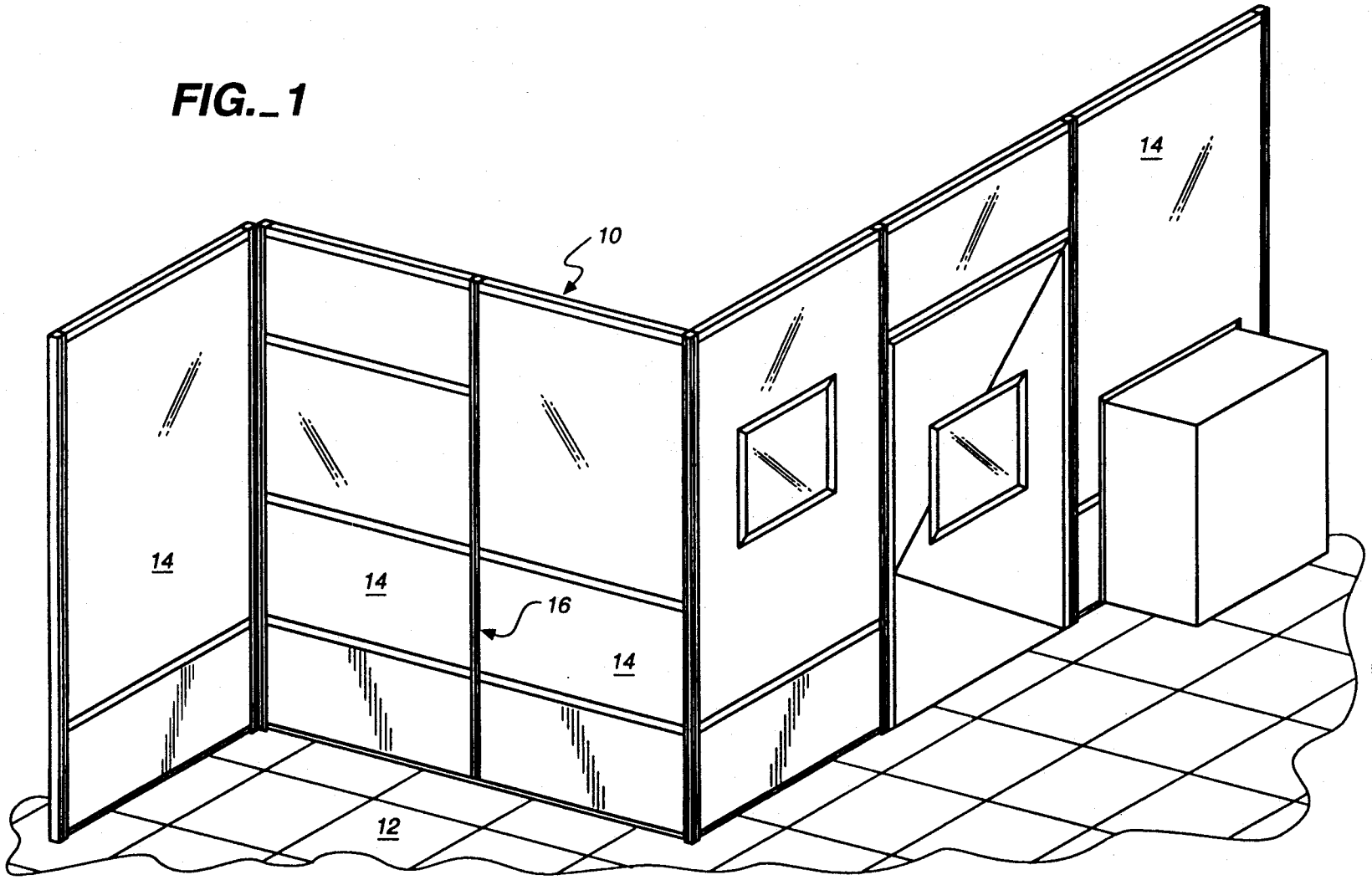
FIG. 1 is a pictorial view of a clean room wall system incorporating features of the present invention.

Referring to the drawings, FIG. 1 illustrates a representative clean room modular wall construction which may be assembled utilizing the framing apparatus of the present invention. The wall 10 extends upwardly from a floor 12 and incorporates a plurality of panel members such as wall panels 14. It will be appreciated that the entire assembly extends upwardly to a ceiling, which for the purposes of simplicity and clarity, is not shown in FIG. 1.

The various panels of the wall 10 are connected together by framing apparatus positionable between opposed ends of adjacent panels for connecting the panels and allowing selective assembly and disassembly of the panels relative to the framing apparatus from opposed side of the panels. For illustrative purposes, the FIG. 1 panels may be considered as being secured together by the form of framing apparatus 16 shown in detail in FIG. 2.

Framing apparatus 16 includes elongated structural means incorporating an elongated core member 18 formed of plastic or other suitable material.

Figure 2:
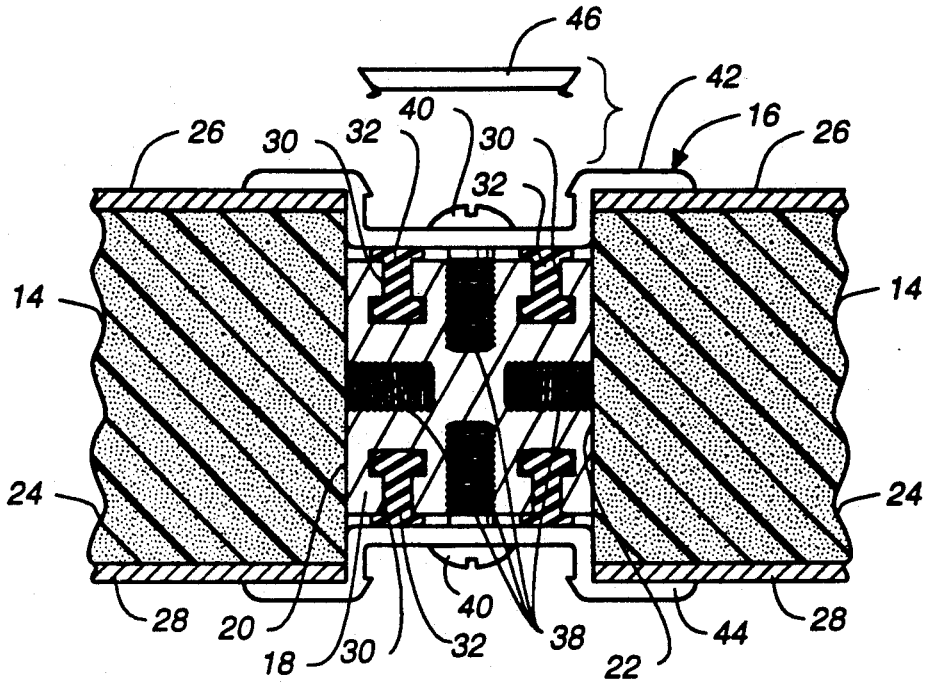
FIG. 2 is a greatly enlarged, fragmentary cross-sectional view of a preferred form of framing apparatus constructed in accordance with the teachings of the present invention in combination with two panel ends.

Elongated core member 18 has opposed contact surfaces 20, 22 disposed on opposite sides thereof for abutting engagement with panels 14, as shown. Each panel 14 is of unitary construction and includes an inner panel segment 24 suitably formed of expanded cell plastic or other suitable material and opposed outer layers 26, 28 of plastic sheeting or the like to provide a finished appearance on both sides of the panels. In the arrangement of FIG. 2, the contact surfaces of the elongated core member are in abutting relationship with the inner panel segments 24 of the two wall panels illustrated.

Elongated core member 18 has a plurality of spaced elongated recesses 30 extending along the length thereof. Each of the recesses accommodates therein gasket means in the form of rubber or plastic gasket strips 32. Gasket strips 32 have outwardly disposed ends which project from the recesses 30. Along the length thereof at spaced locations, the elongated core member has formed therein a plurality of threaded holes 38. In the embodiment of FIG. 2, threaded holes 38 extend inwardly from all four outer sides of the elongated core member 18. The threaded holes 38 extending inwardly from the outwardly disposed sides of elongated core member 18 accommodate therein screws 40. The threaded holes 38 extending inwardly from contact surfaces 20, 22 are empty in the present instance; however, it will be appreciated that in some operating environments, the empty threaded holes may be utilized to secure the elongated core member to another operating structure of some kind.

Screws 40 secure flange members 42, 44 to the elongated core member, the ends of the wall panels 14 being secured into position relative to the elongated core member by the outer portions of the flange members.

The outer ends of the screws 40 are disposed within elongated channels formed by the flange members along the length thereof. Elongated cover plates 46 (only one of which is shown) may be snap-fastened or otherwise secured to the flange members to hide the screws and present a pleasing, finished appearance.

The arrangement just described provides a generally air-tight seal. It will be appreciated that gasket strips 32 compress between the flange members and the elongated core member when the flange members are tightened into position by their associated screws 40.

Figure 2A:
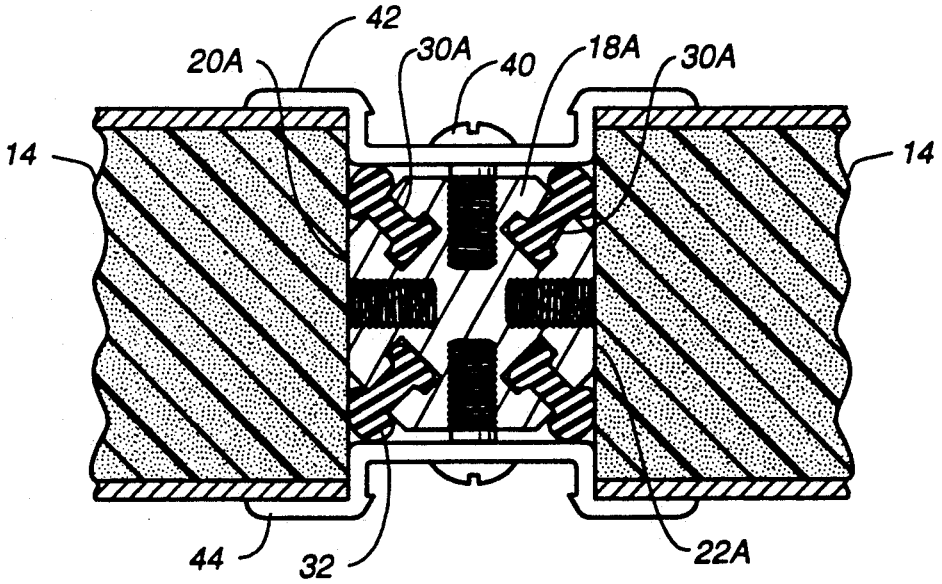
FIG. 2A is a view similar to FIG. 2 but illustrating an alternative embodiment of framing apparatus.

The embodiment of FIG. 2A is quite similar to that shown in FIG. 2; however, in FIG. 2A the elongated core member 18A is eight-sided rather than square. The spaced elongated recesses 30A are disposed at 45 degree angles relative to the contact surfaces 20A, 22A of the elongated core member. The gasket strips 32A projecting from the recesses 30A engage both the end panels 14 and the flange members 42, 44, when the flange members are tightened into position.

Figure 3:
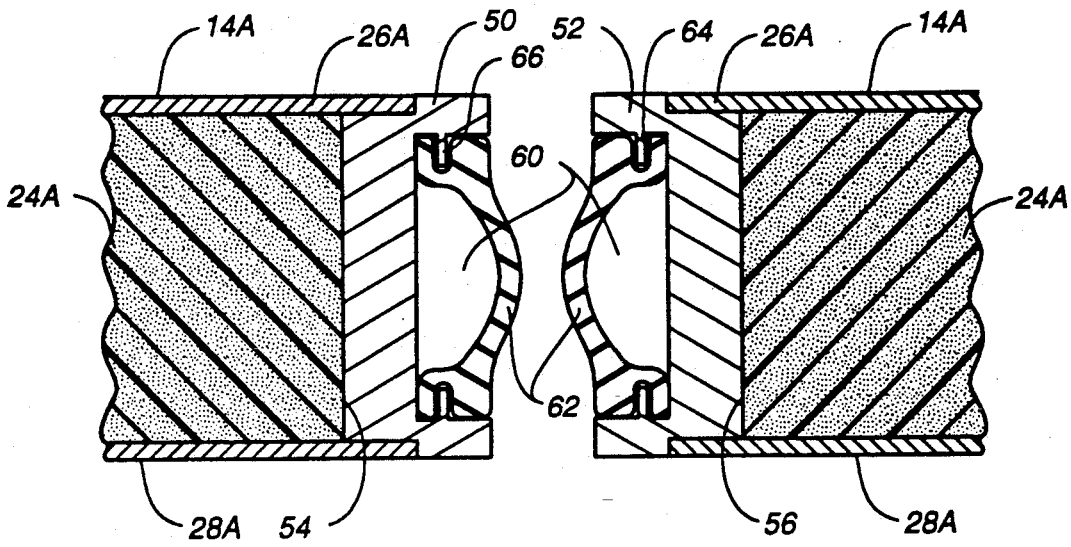
FIG. 3 is a greatly enlarged, fragmentary, cross-sectional view of yet another embodiment of framing apparatus constructed in accordance with the teachings of the present invention connected to two panel ends just prior to engagement being made between two core segments of the framing apparatus.
Figure 3A:
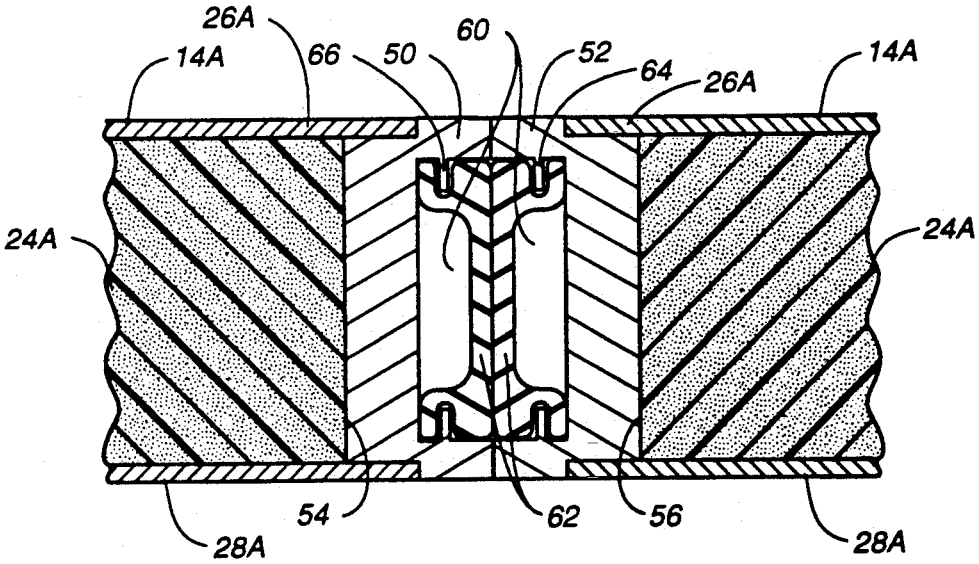
FIG. 3A is a view similar to FIG. 3 but illustrating the core segments in engagement.

FIGS. 3, 3A illustrate yet another embodiment of the present invention. Here, the outer layers 26A, 28A of the panels 14A extend beyond the inner panel segment 24A thereof.

The elongated structural means in this modification is in the form of two core segments 50, 52, portions of the core segments being partially positioned between outer layers 26A, 28A so that the contact surfaces 54, 56 thereof engage the inner panel segment 24.

Each of the core segments 50, 52 defines an elongated recess 60 accommodating a gasket strip 62. It should be noted that when the gasket strips 62 are separated and in unstressed condition, the strips project outwardly beyond the recesses 60. Gasket strips 62 may be secured to the core segments 50, 52 in any desired manner. In the arrangement illustrated, the gasket strips have elongated grooves 64 formed along the length thereof which accommodate projections 66 of the core segments.

A generally air-tight seal is formed when the panels 14A are pushed together and the two gasket strips 62 engage and deform so that they are in contact over substantially the full extent thereof.

Figure 4:
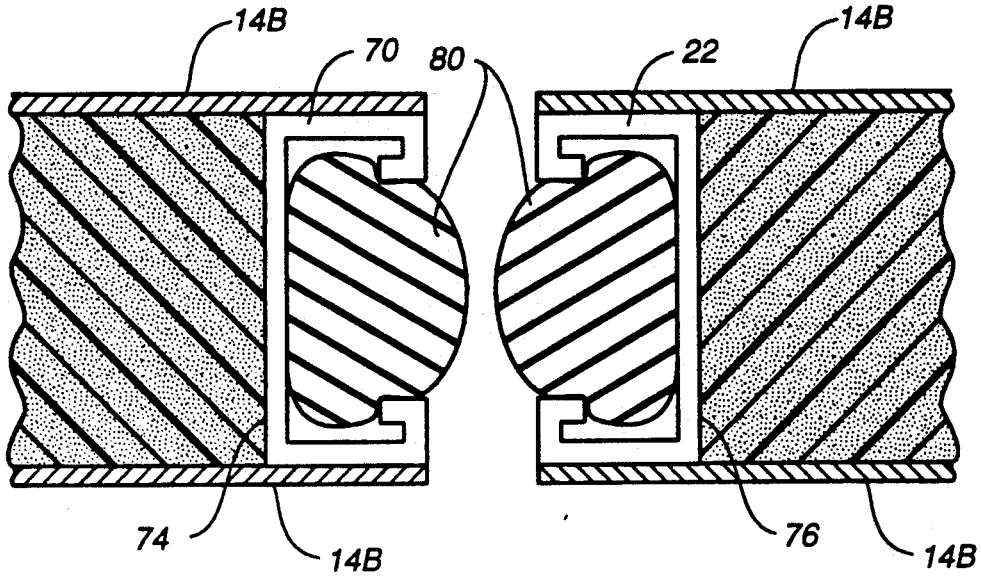
FIGS. 4-4A are views similar to FIGS. 3, 3A, respectively, illustrating yet another alternative embodiment of the framing apparatus.
Figure 4A:
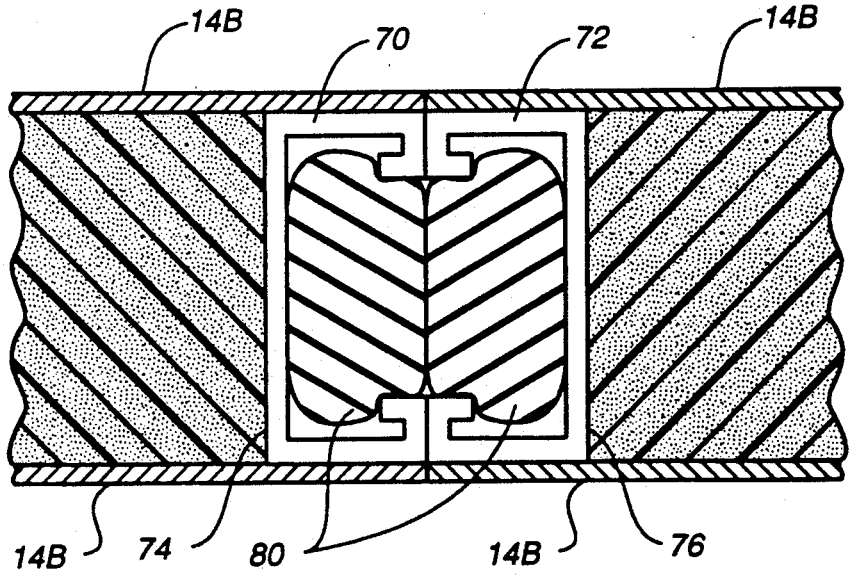

FIGS. 4, 4A show another arrangement wherein abutment of wall panels causes engagement of gasket means to form a generally air-tight seal between the panels. In the FIG. 4-4A structure, the elongated core member is comprised of two generally channel-shaped core segments 70, 72 having their respective contact surfaces 74, 76 contacting the inner panel segment of panels 14B. The interiors of the channel-shaped core segments accommodate therein gasket means in the form of gaskets 80 formed of extruded resilient material, a preferred form thereof being closed cell neoprene. Extruded gaskets 80 engage and form a generally air-tight seal when the wall panels 14B are brought into abutting engagement, as shown in FIG. 4A.

Figure 5:
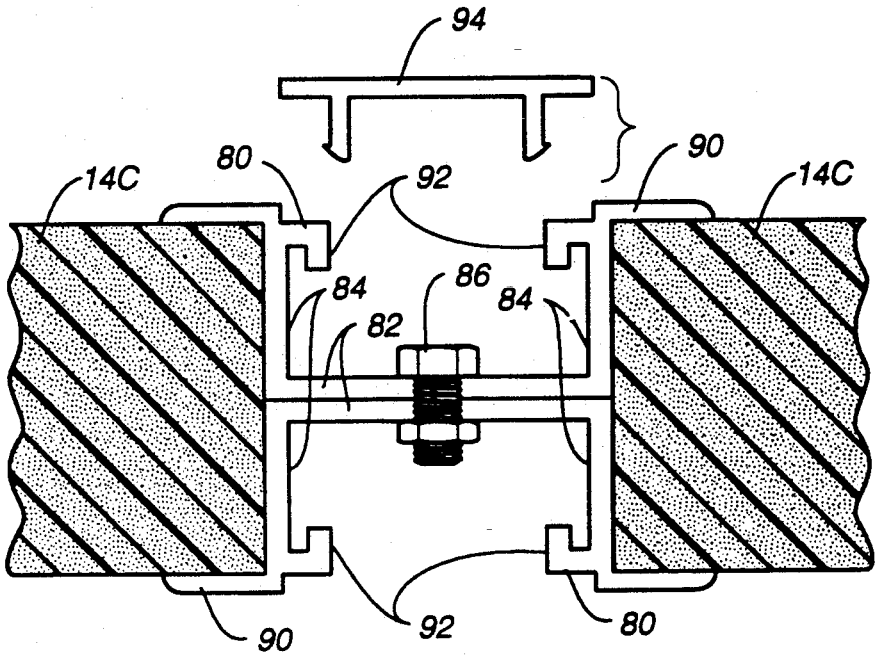
FIG. 5 is a greatly enlarged, fragmentary cross-sectional view of still another embodiment of the framing apparatus of the present invention, showing such apparatus in operative association with two panel ends.

In the arrangement of FIG. 5, the elongated structural means is in the form of a pair of channel members 80, each channel member including a primary wall 82 and two spaced side walls 84 projecting from the primary walls to define an elongated open channel. A bolt and nut arrangement 86 is utilized to secure the channel members 80 back-to-back along their primary walls 82 so that the elongated open channels defined by the channel members open outwardly at both sides of the wall.

Flanges 90 project outwardly from the side walls, as shown, and engage the opposed ends of adjacent panels 14C. That is, the panels 14C are friction fit between the flanges of the channel members. In this embodiment, wall panels 14C are of unitary construction and do not incorporate outer layers; however, it will be appreciated that the arrangement of FIG. 5 may be utilized with multi-layered wall panel constructions.

Lips 92 project inwardly from side walls 84. Cover plates 94 (only one of which is illustrated) are adapted to be positioned over the recesses defined by channel members 80 and snap-fit to the lips 92.

Figure 6:
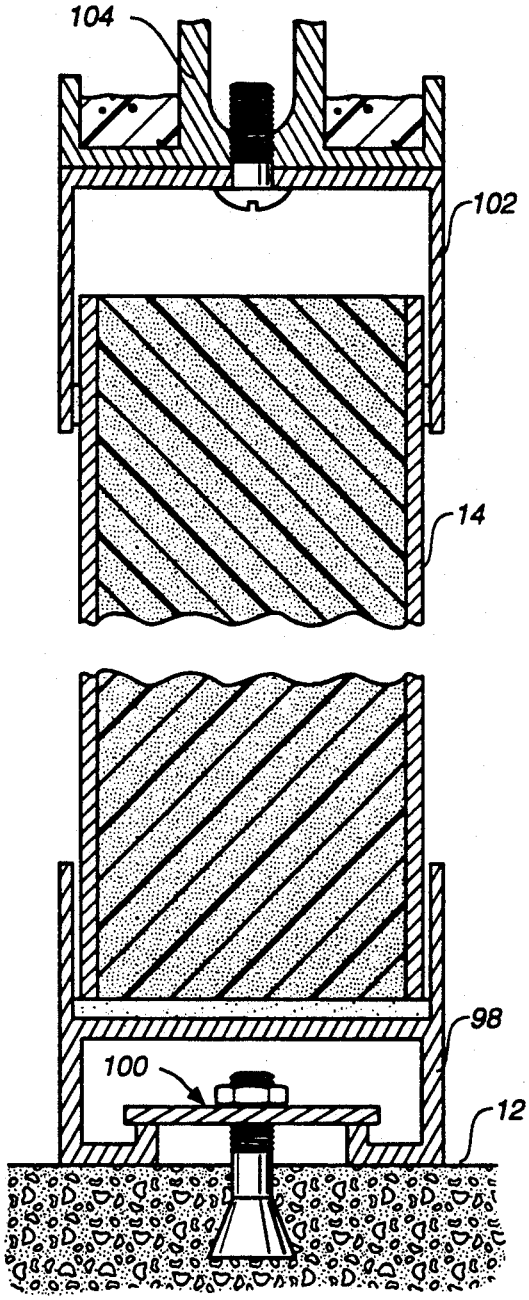
FIG. 6 is a fragmentary, cross-sectional side view of a representative wall system incorporating the teachings of the present invention and including fittings employed at the upper and lower ends of the system to connect the system to the floor and ceiling.

FIG. 6 is a cross-sectional fragmentary side view illustrating a wall panel 14 extending between a channel fitting 98 secured to a concrete floor 12 by anchor means 100 to a channel fitting 102 secured to a ceiling fixture 104. It will be appreciated that some head room is employed within channel fitting 102 to accommodate variances in room height as well as any ceiling or floor movement which may result, for example, from earthquake or other cause.

Figure 6A:
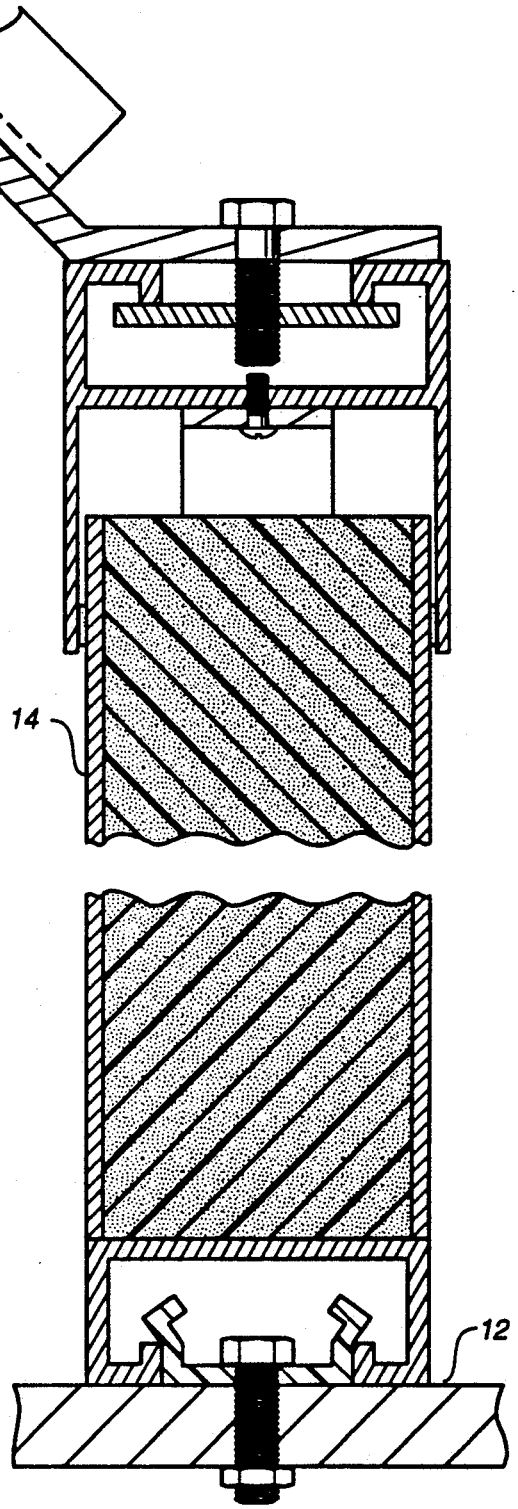
FIG. 6A is a view similar to FIG. 6 but illustrating alternative floor and ceiling fittings.

FIG. 6A discloses another arrangement for positioned a wall panel 14A relative to a floor and ceiling. It will be appreciated that, as is the case with the FIG. 6 embodiment, the wall panel 14 in the FIG. 6A embodiment may readily be moved end-to-end in a horizontal direction relative to the floor and ceiling in the absence of obstructions to such movement.

I claim:

1. Framing apparatus positionable between opposed ends of adjacent panels for connecting said panels and allowing selective assembly and disassembly of said panels relative to said framing apparatus from opposed sides of said panels, said opposed ends having a predetermined thickness, and said framing apparatus, in combination with two panels, comprising:

elongated structural means including an elongated core member of integral, unitary construction having opposed contact surfaces positionable between said adjacent panel opposed ends and abuttingly engageable by said opposed ends at said opposed contact surfaces, said elongated core member further having opposed outer surfaces between said opposed contact surfaces, said elongated core member defining a plurality of spaced elongated recesses extending substantially along the length of elongation of said elongated core member and extending inwardly from opposed outer surfaces thereof, said opposed outer surfaces of said elongated core member being spaced apart a distance less than the predetermined thickness of said panel ends whereby said opposed outer surfaces are disposed inwardly of said panel sides when said elongated core member is positioned between said adjacent panel opposed ends, and said elongated structural means including connector means for interconnecting said elongated structural means and said opposed panel ends, said connector means including a pair of elongated flange members, said flange members positionable at said opposed outer surfaces of said elongated core member and at opposed sides of panels and each flange member including outer flange member portions engageable with aligned sides of adjacent panels and a central portion positionable between adjacent panel opposed ends, said connector means additionally including fastener means for releasably fastening said elongated flange members to said elongated core member with panels positioned between said elongated flange members and said elongated flange members maintaining said panels in at least partial registry, said fastener means being selectively accessible from opposed surfaces of said elongated core member; and gasket means disposed in said elongated recesses, extending substantially along the lengths of said recesses, and projecting outwardly therefrom when said gasket means is in unstressed condition, said gasket means compressing and forming a generally air-tight seal between said panels when said framing apparatus and said panels are assembled, said gasket means including a plurality of elongated gasket strips engaging said central portion of said elongated flange members and compressed thereby when said elongated flange members are fastened to said elongated core member by said fastener means.

2. The framing apparatus according to claim 1 wherein at least some of said plurality of gasket strips engage said adjacent panel opposed ends when said elongated flange members are fastened to said elongated core member by said fastener means.

3. The framing apparatus according to claim 1 wherein said control portion of said elongated flange members each define an elongated channel extending along the length thereof for accommodating said fastener means.

4. The framing apparatus according to claim 3 additionally comprising cover means releasably connectable to said elongated flange members for selectively covering said channels and the fastener means accommodated within said channels.

5. The framing apparatus according to claim 4 wherein said cover means comprises an elongated cover plate for covering each said channel.

6. The framing apparatus according to claim 1 wherein said elongated core member defines threaded openings between gasket strips, said elongated flange member central portions defining apertures registrable with said threaded openings, said fastener means comprising screw members projecting through said elongated flange element apertures and threadedly engaged with said elongated core member threaded openings when said elongated flange members are fastened to said elongated core member.

7. The framing apparatus according to claim 1 wherein said gasket means comprises at least one strip of extruded resilient material.

8. The framing apparatus according to claim 7 wherein said extruded resilient material is closed cell neoprene.

* * * * *